US007610882B2

(12) United States Patent
Tsutsumi et al.

(10) Patent No.: US 7,610,882 B2
(45) Date of Patent: Nov. 3, 2009

(54) DEFAULT DEVICE OF ACTUATOR FOR VARIABLE LIFT VALVE OPERATING MECHANISM

(75) Inventors: Michihisa Tsutsumi, Saitama (JP); Shigeru Maruyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 322 days.

(21) Appl. No.: 11/701,551

(22) Filed: Feb. 2, 2007

(65) Prior Publication Data

US 2007/0199530 A1 Aug. 30, 2007

(30) Foreign Application Priority Data

Feb. 22, 2006 (JP) ..... 2006-045199

(51) Int. Cl.
*F01L 1/34* (2006.01)

(52) U.S. Cl. ..... 123/90.16; 123/90.39

(58) Field of Classification Search ..... 123/90.2, 123/90.16, 90.39, 90.44, 90.45; 74/559, 74/569

See application file for complete search history.

(56) References Cited

U.S. PATENT DOCUMENTS

| | | | | |
|---|---|---|---|---|
| 5,003,939 | A | 4/1991 | King | |
| 5,680,837 | A | 10/1997 | Pierik | |
| 6,532,924 | B1 | 3/2003 | Pierik | |
| 2004/0020454 | A1 * | 2/2004 | Koro et al. | 123/90.16 |
| 2005/0211204 | A1 | 9/2005 | Todo et al. | |

FOREIGN PATENT DOCUMENTS

| | | | |
|---|---|---|---|
| EP | 1 717 428 | A1 | 11/2006 |
| EP | 1 754 865 | A2 | 2/2007 |
| JP | 59-41649 | U | 3/1984 |
| JP | 57-188717 | A | 11/1985 |
| JP | 62-74108 | U | 5/1987 |
| JP | 11-324625 | A | 11/1999 |
| JP | 2000-085398 | A | 3/2000 |
| JP | 2000-227010 | A | 8/2000 |
| JP | 2000-234508 | A | 8/2000 |
| JP | 2002-227010 | A | 8/2000 |
| WO | WO 2005-075798 | A1 | 8/2005 |
| WO | WO 2007/058092 | A1 | 5/2007 |

* cited by examiner

*Primary Examiner*—Zelalem Eshete
(74) *Attorney, Agent, or Firm*—Arent Fox LLP

(57) ABSTRACT

In a default device of an actuator for a variable lift valve operating mechanism, in the event of failure of the actuator, a pressed portion of a lever pivotably supported on a support shaft is urged by a resilient force of a coil spring, an arm is pressed by a cam portion of the lever to rotate a control shaft in one direction to prevent valve lift from being a predetermined value or lower. The support shaft that pivotably supports the lever of a default mechanism is placed in a position offset from a rotation axis of the control shaft. Thus, as compared with the case where the support shaft is placed coaxially with the control shaft, a large urging force is input from the lever to the control shaft to reliably prevent the valve lift from being the predetermined value or lower.

19 Claims, 14 Drawing Sheets

HIGH LIFT STATE

LOW LIFT STATE

DEFAULT DEVICE OF ACTUATOR FOR VARIABLE LIFT VALVE OPERATING MECHANISM

RELATED APPLICATION DATA

The present invention is based upon Japanese priority application No. 2006-45199, which is hereby incorporated in its entirety herein by reference.

BACKGROUND OF THE INVENTION

1. Field of the Invention

The present invention relates to a default device of an actuator for a variable lift valve operating mechanism in which in the event of failure of the actuator that rotatably drives a control shaft of a variable lift valve operating mechanism capable of varying valve lift of an engine valve of an internal combustion engine, the control shaft is urged in one direction by an urging member of a default mechanism to prevent the valve lift from being a predetermined value or lower.

2. Description of the Related Art

Japanese Patent Application Laid-Open No. 2000-227010 discloses a variable lift valve operating device of an internal combustion engine in which a control shaft is rotated by an electric motor via a drive gear and a driven gear to vary a position of a pivot of a rocker arm, and valve lift or valve timing of an intake valve is variably controlled according to an engine operation state.

The variable lift valve operating device includes a default mechanism for stopping the control shaft in an intermediate position between a maximum valve lift position and a minimum valve lift position so as to continue an operation of the internal combustion engine without any problems in the event of failure of the electric motor when the control shaft is placed in the maximum valve lift position or the minimum valve lift position. The default mechanism is placed between an end of the control shaft and the driven gear relatively rotatably supported on an outer periphery of the end. The default mechanism is adapted to return the control shaft and the driven gear to a position where intermediate valve lift between the maximum valve lift and the minimum valve lift can be obtained by a resilient force of a coil spring housed in the driven gear in the event of failure of the electric motor, and relatively non-rotatably lock the control shaft and the driven gear with a lock pin.

The default mechanism described in Japanese Patent Application Laid-Open No. 2000-227010 is placed between the control shaft and the driven gear which are coaxially placed. In order to obtain a sufficient default load with the resilient force of the coil spring, there is a need for increasing the size of the coil spring or increasing the diameter of the driven gear that houses the coil spring, in either case the size of the default mechanism disadvantageously increases.

SUMMARY OF THE INVENTION

The present invention has been achieved in view of the above described circumstances, and has an object to provide a default device of an actuator for a variable lift valve operating mechanism that reliably stops a control shaft in a target position by generating a sufficient default load without upsizing the device.

In order to achieve the above object, according to a first feature of the present invention, there is provided a default device of an actuator for a variable lift valve operating mechanism in which in the event of failure of an actuator that rotatably drives a control shaft of a variable lift valve operating mechanism capable of varying valve lift of an engine valve of an internal combustion engine, the control shaft is urged in one direction by an urging member of a default mechanism to prevent the valve lift from being a predetermined value or lower or higher, wherein a support shaft that pivotably supports the urging member is offset from a rotation axis of the control shaft.

With the above described configuration, in the default device of the actuator for the variable lift valve operating mechanism in which in the event of failure of the actuator, the control shaft is urged in one direction to prevent the valve lift from being a predetermined value or lower or higher, the support shaft that pivotably supports the urging member of the default mechanism is placed in the position offset from the rotation axis of the control shaft. Thus, as compared with the case where the support shaft is placed coaxially with the control shaft, a large urging force is input from the urging member to the control shaft to reliably prevent the valve lift from being the predetermined value or lower or higher.

According to a second feature of the present invention, in addition to the first feature, the urging member is a lever pivotably supported at an intermediate portion thereof by the support shaft, and one end of the lever is urged by a spring and the other end thereof abuts a driven portion of the control shaft.

With the above described configuration, the urging member that urges the control shaft in one direction comprises the lever pivotably supported at the intermediate portion thereof, and one end of the lever is urged by the spring and the other end thereof abuts the driven portion of the control shaft, thereby downsizing the spring by increasing a lever ratio without upsizing the lever.

According to a third feature of the present invention, in addition to the first or second feature, the actuator comprises a driven gear provided on the control shaft, and a drive gear that meshes with a lower portion of the driven gear, and the support shaft of the lever is placed below the drive gear in a cylinder axial direction.

With the above described configuration, in the device in which the actuator includes the driven gear provided on the control shaft, and the drive gear that meshes with the lower portion of the driven gear, the support shaft of the lever is placed below the drive gear in the cylinder axial direction. Thus, the lever can be placed in a compact manner using a space below the drive gear without interference with the drive gear and the driven gear, and further a distance from the support shaft to one end of the lever and a distance from the support shaft to the other end of the lever can be increased, thereby allowing the spring to be made compact by increasing a lever ratio.

According to a fourth feature of the present invention, in addition to the second or third feature, one end of the lever slidably engages a rod-shaped spring guide that guides expansion and contraction of the spring.

With the above described configuration, one end of the lever slidably engages the rod-shaped spring guide that guides expansion and contraction of the spring, and thus the spring guide prevents the lever from falling, thereby allowing a smooth swing of the lever.

According to a fifth feature of the present invention, in addition to the fourth feature, the rod-shaped spring guide is provided on at least one side of a drive shaft that drives the control shaft.

With the above described configuration, the rod-shaped spring guide is provided on at least one side of the drive shaft that drives the control shaft, thereby avoiding interference between the spring guide and the drive shaft.

According to a sixth feature of the present invention, in addition to the fourth feature, a pair of the rod-shaped spring guides are provided on opposite sides of a drive shaft that drives the control shaft.

With the above described configuration, the pair of rod-shaped spring guides are provided on the opposite sides of the drive shaft that drives the control shaft, thereby avoiding interference between the spring guide and the drive shaft.

According to a seventh feature of the present invention, in addition to the fourth feature, at least part of the driven gear overlaps the rod-shaped spring guide in an axial direction of the control shaft.

With the above described configuration, at least part of the driven gear overlaps the rod-shaped spring guide in the axial direction of the control shaft, thereby arranging the driven gear and the spring guide in a compact manner.

According to an eighth feature of the present invention, in addition to the fifth or sixth feature, at least part of the driven gear overlaps a pair of the rod-shaped spring guides in an axial direction of the control shaft, and is placed between the pair of rod-shaped spring guides.

With the above described configuration, at least part of the driven gear overlaps the pair of rod-shaped spring guides, and is placed between the pair of rod-shaped spring guides in the axial direction of the control shaft, thereby arranging the driven gear and the spring guide in a compact manner.

An intake valve 16 of an embodiment corresponds to the engine valve of the present invention, a worm wheel 70 of the embodiment corresponds to the driven gear of the present invention, a worm 71 of the embodiment corresponds to the drive gear of the present invention, a first lever 73 of the embodiment corresponds to the urging member of the present invention, a first coil spring 75 of the embodiment corresponds to the spring of the present invention, a first spring guide 76 of the embodiment corresponds to the spring guide of the present invention, and an arm 85 of the embodiment corresponds to the driven portion of the present invention.

The above-mentioned object, other objects, characteristics, and advantages of the present invention will become apparent from preferred embodiments, which will be described in detail below by reference to the attached drawings.

BRIEF DESCRIPTION OF THE DRAWINGS

FIGS. 1 to 12C show an embodiment of the present invention wherein

FIG. 1 is a vertical sectional side view of essential portions of an internal combustion engine;

FIG. 2 is a sectional view taking along line 2-2 in FIG. 1;

FIG. 3 is an exploded perspective view of essential portions of a valve operating device;

FIG. 4 is a sectional view taken along line 4-4 in FIG. 2 in a high lift state;

FIG. 5 is a sectional view in a low lift state corresponding to FIG. 4;

FIG. 6 is a perspective view of an actuator and a default mechanism;

FIG. 7 is a view taken in the direction of arrow 7 in FIGS. 6 and 8;

FIG. 8 is a sectional view taken along line 8-8 in FIG. 7;

FIG. 9 is a sectional view taken along line 9-9 in FIG. 7;

FIG. 10 is a sectional view taken along line 10-10 in FIG. 7;

FIG. 11 is a sectional view taken along line 11-11 in FIG. 7; and

FIGS. 12A to 12C illustrate an operation of the default mechanism.

DESCRIPTION OF THE PREFERRED EMBODIMENTS

Figure 6:
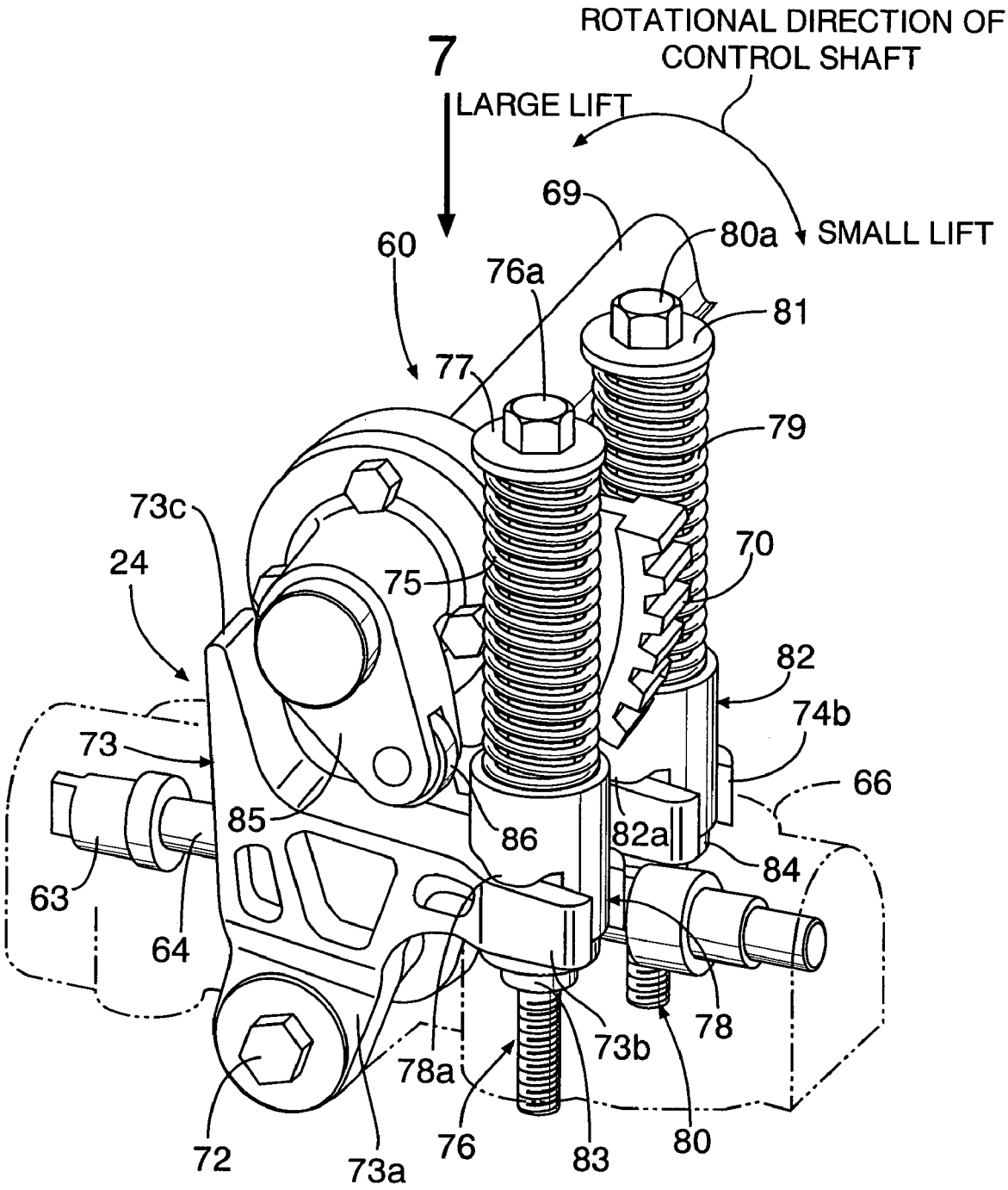
Figure 7:
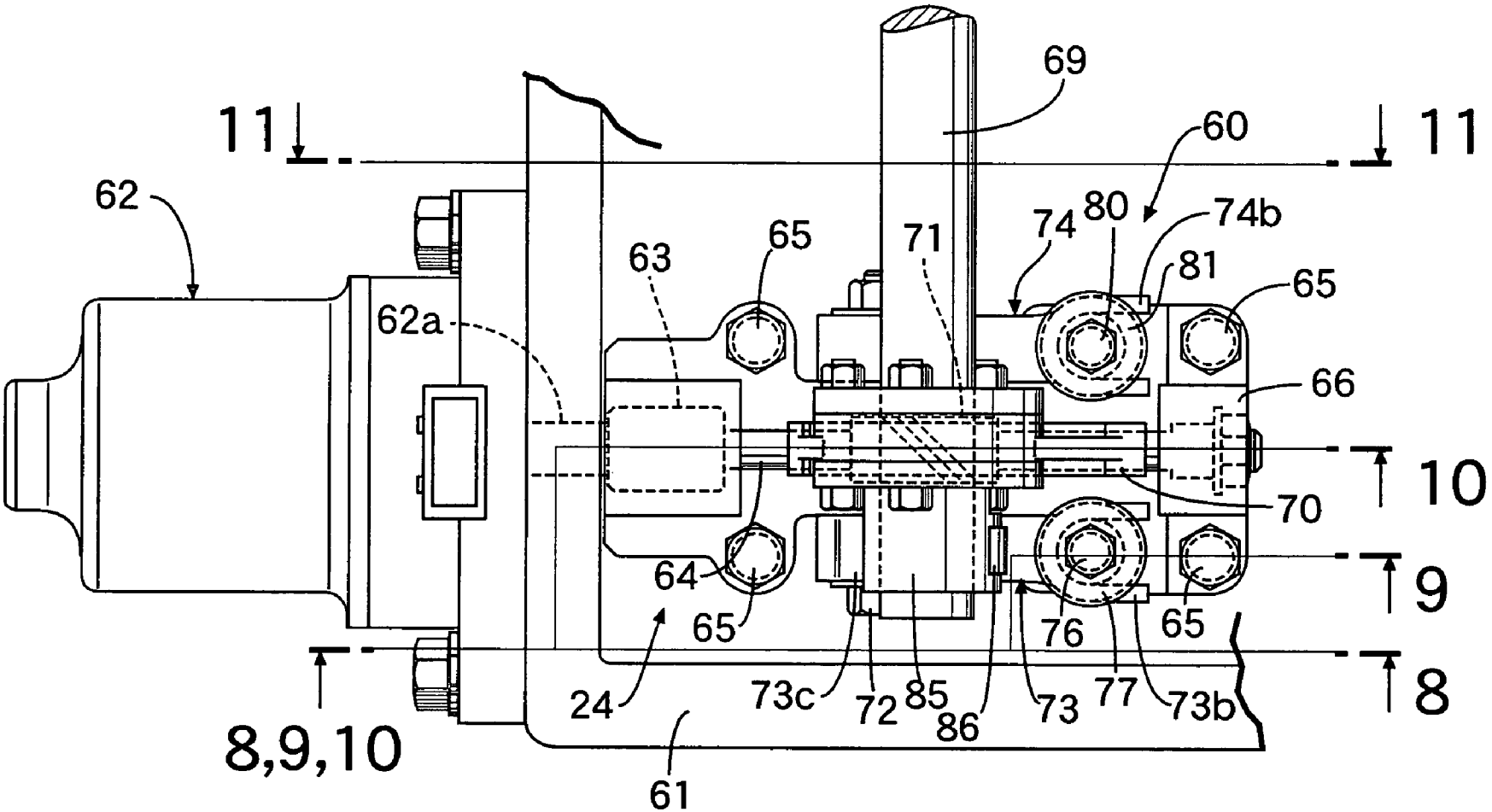
Figure 8:
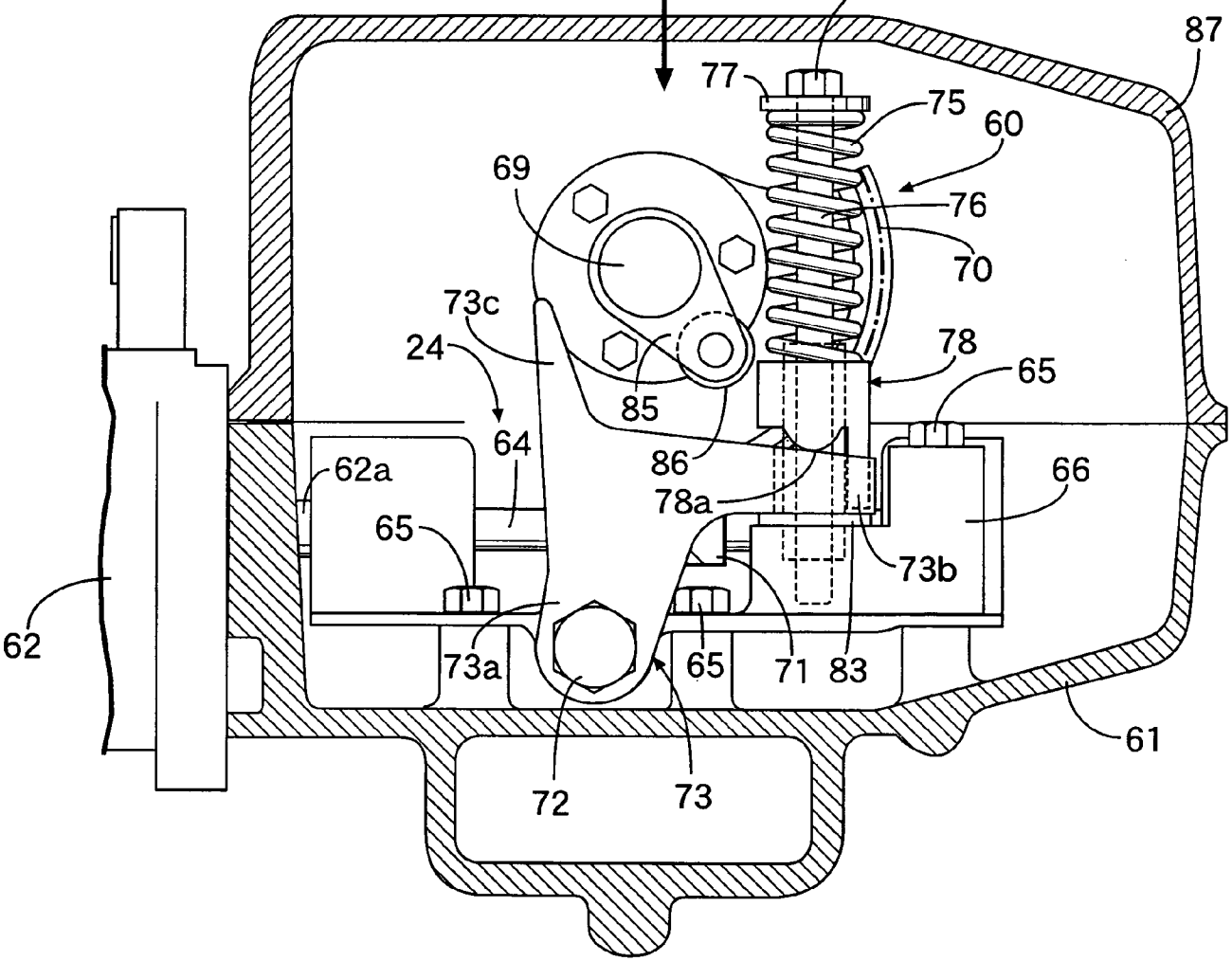
Figure 9:
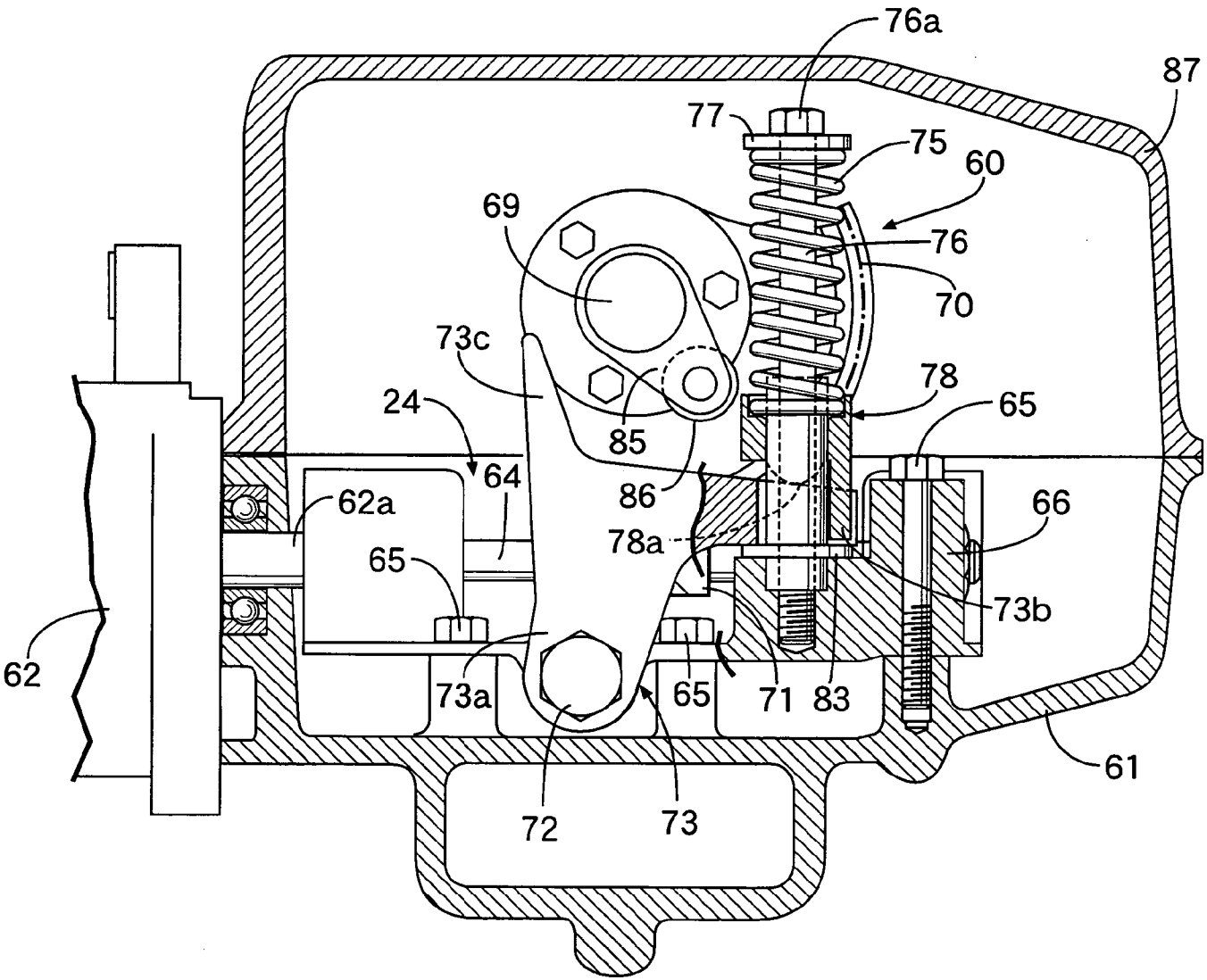
Figure 10:
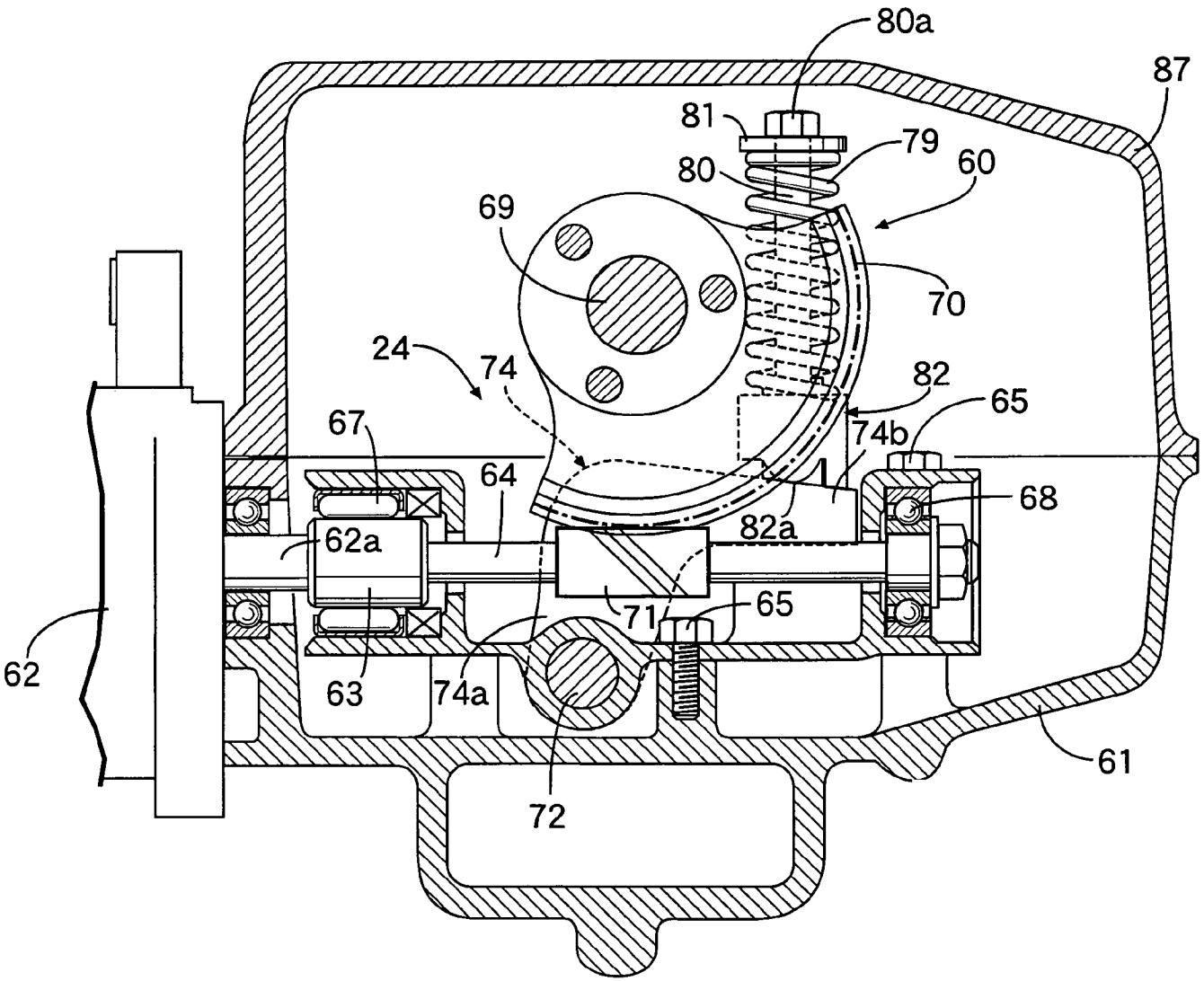
Figure 11:
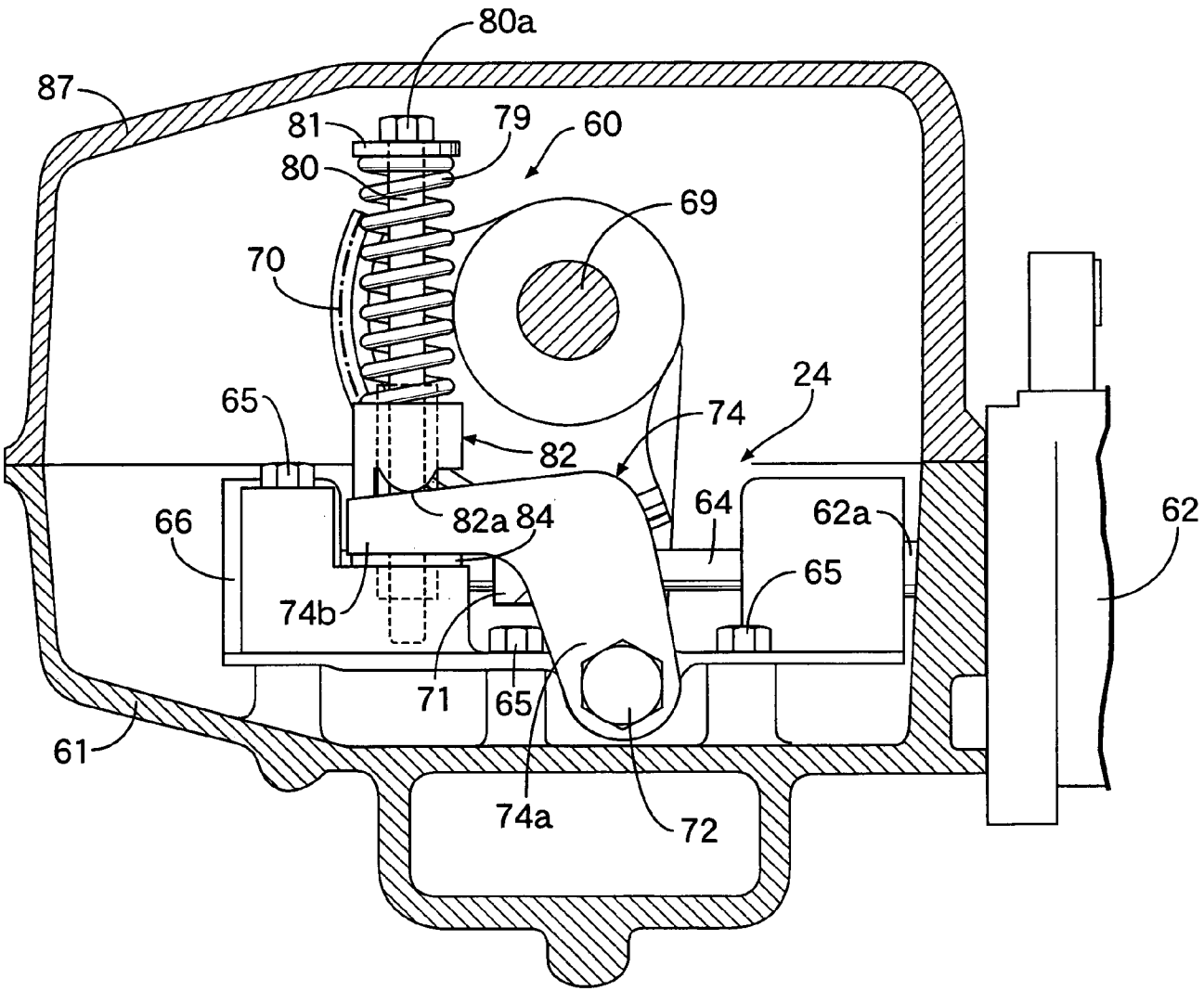

First, in FIGS. 1 to 4, intake valves 16 and 16 that are a pair of engine valves for each cylinder are openably and closably provided in a cylinder head 15 that constitutes part of an engine body 14. A variable lift valve operating mechanism 17 that openably and closably drives the intake valves 16 and 16 includes a cam shaft 19 having lift valve cams 18 and 18 corresponding to the intake valves 16 and 16, a pair of sub cams 21 and 21 that are supported pivotably by a movable support shaft 20 displaceable in a plane perpendicular to a rotation axis of the lift valve cams 18 and 18, that is, to an axis of the cam shaft 19, and pivoted following the lift valve cams 18 and 18, a pair of rocker arms 22 and 22 that are interlocked with and connected to the intake valves 16 and 16, and follow the sub cams 21 and 21, a control arm 23 that is connected to the movable support shaft 20, can be rotated around an axis parallel to the axis of the lift valve cams 18 and 18, that is, to the axis of the cam shaft 19, and holds the movable support shaft 20 in a position offset from the rotation axis, and an actuator 24 (see FIG. 6) that rotatably drives the control arm 23, and the movable support shaft 20 can be displaced to vary operation characteristics including lift amounts of the intake valves 16 and 16.

Stems 16*a* and 16*a* of the intake valves 16 and 16 are slidably fitted in guide cylinders 25 and 25 provided in the cylinder head 15. The intake valves 16 and 16 are urged in a valve closing direction by valve springs 28 and 28 provided between retainers 26 and 26 provided on upper ends of the stems 16*a* and 16*a* and retainers 27 and 27 that abut against the cylinder head 15.

Cam holders 29 and 29 (see FIG. 2) are provided in the cylinder head 15 on the opposite sides of the pair of intake valves 16 and 16. Caps 30 and 30 that rotatably support the cam shaft 19 in cooperation with the cam holders 29 and 29 are fastened to upper surfaces of the cam holders 29 and 29.

One ends of the rocker arms 22 and 22 are pivotably supported by the control arm 23 via hydraulic tappets 31 and 31. The other ends of the rocker arms 22 and 22 have valve abutment portions 22*a* and 22*a* that abut against the upper ends of the stems 16*a* and 16*a* of the intake valves 16 and 16. Further, first rollers 33 and 33 are journaled on intermediate portions of the rocker arms 22 and 22 via needle bearings 32 and 32. The first rollers 33 and 33 are brought into rolling contact with sub cams 21 and 21 corresponding to the rocker arms 22 and 22.

The control arm 23 integrally includes: side walls 23*a* and 23*a* placed on the opposite sides of the intake valves 16 and 16 with spaces therebetween along a rotation axis of the control arm 23; shaft portions 23*b* and 23*b* connected to outer surfaces of the side walls 23*a* and 23*a* at right angles with an axis parallel to the cam shaft 19 as a rotation axis C; a first connecting wall portion 23*c* that connects one ends of the side walls 23*a* and 23*a*; and a second connecting wall portion 23*d* that connects the other ends of the side walls 23*a* and 23*a*. The shaft portions 23*b* and 23*b* are rotatably fitted in support holes 34 and 34 provided in the cam holders 29 and 29. Specifically, the control arm 23 is rotatably supported by the cam holders 29 and 29.

The rotation axis C of the control arm 23, that is, the axis of the shaft portions 23*b* and 23*b* is placed above the stems 16*a* and 16*a* of the intake valves 16 and 16. The valve abutment portions 22*a* and 22*a* provided on the other ends of the rocker arms 22 and 22 are formed along an arc A (shown in phantom in FIG. 4) around the rotation axis C of the control arm 23 when the intake valves 16 and 16 are in a closing and seated state.

Further, in a projection view on a plane perpendicular to the rotation axis C of the control arm 23, the rotation axis C of the control arm 23 is placed in an upward extended width W (a width shown by chain lines in FIG. 1) of the stems 16*a* and 16*a*.

The movable support shaft 20 having the axis parallel to the cam shaft 19 passes through the sub cams 21 and 21 placed inside the side walls 23*a* and 23*a* of the control arm 23, and a cylindrical spacer 35 mounted between the sub cams 21 and 21. Opposite ends of the movable support shaft 20 abut against inner side surfaces of the side walls 23*a* and 23*a*. Bolts 36 and 36 inserted through the side walls 23*a* and 23*a* are screwed into the opposite ends of the movable support shaft 20. Needle bearings 37 and 37 are mounted between the movable support shaft 20 and the sub cams 21 and 21.

Specifically, the sub cams 21 and 21 are rotatably supported by the movable support shaft 20 having the opposite ends detachably mounted to the side walls 29*a* and 29*a* of the control arm 23, and the spacer 35 separate from the movable support shaft 20 is placed between the sub cams 21 and 21 and fitted to the outer periphery of the movable support shaft 20.

Further, a pair of support arm portions 21*a* and 21*a* that are formed into substantially U-shapes opening on the side of the cam shaft 19 and extend below the cam shaft 19 are integrally provided in portions of the sub cams 21 and 21 corresponding to portions between the shaft portions 23*b* and 23*a* of the control arm 23 and the movable support shaft 20. Second rollers 40 and 40 are pivotably supported on support shafts 38 and 38 secured between tip ends of the support arm portions 21*a* and 21*a* via needle bearings 39. The second rollers 40 and 40 are brought into rolling contact with the lift valve cams 18 and 18 of the cam shaft 19. Specifically, the sub cams 21 and 21 are driven rotatably around the axis of the movable support shaft 20 by the second rollers 40 and 40 being brought into contact with the lift valve cams 18 and 18 of the cam shaft 19.

Pressure receiving arm portions 21*b* and 21*b* are integrally provided on the sub cams 21 and 21 on the side opposite from the cam shaft 19 with respect to the support shafts 38 and 38. Spring forces that urge the sub cams 21 and 21 are applied to the pressure receiving arm portions 21*b* toward the side in which the second rollers 40 and 40 are brought into rolling contact with the lift valve cams 18 and 18.

Specifically, bottomed cylindrical guide cylinders 43 and 43 that have end walls 43*a* and 43*a* on ends opposite from the sub cams 21 and 21 and extend to the side opposite from the sub cams 21 and 21 are integrally provided on the second connecting wall portion 23*d* of the control arm 23 correspondingly to the sub cams 21 and 21. Lost motion springs 45 and 45 are provided under compression between abutment frames 44 and 44 that abut against the pressure receiving arm portions 21*b* and 21*b* of the sub cams 21 and 21 and the end walls 43*a* and 43*a* of the guide cylinders 43 and 43.

In lower surfaces of the sub cams 21 and 21, abutment surfaces 46 and 46 are provided with which the first rollers 33 and 33 of the rocker arms 22 and 22 are brought into rolling contact. Each abutment surface 46 comprises: a lift portion 46*a* that rotatably drives the rocker arm 22; and a base circular portion 46*b* which is equidistant from the axis of the movable support shaft 20 so as to hold the rocker arm 22 in a static state and which is connected to the lift portion 46*a*. The lift portion 46*a* is formed to linearly extend so that a distance between a contact point of the lift portion 46*a* with the first roller 33 of the rocker arm 22 and the axis of the movable support shaft 20 is gradually increased when the sub cam 21 is rotated with rotation of the lift valve cam 18.

Bottomed cylindrical tappet mounting cylinders 47 and 47 that have end walls 47*a* and 47*a* on ends opposite from the movable support shaft 20 and extend to the side opposite from the movable support shaft 20 are integrally provided in portions corresponding to the rocker arms 22 and 22 in the first connecting wall portion 23*c* of the control arm 23. The hydraulic tappets 31 and 31 are mounted to the tappet mounting cylinders 47 and 47.

Each hydraulic tappet 31 includes: a bottomed cylindrical body 48 fitted and mounted in the tappet mounting cylinder 47 with a closed end abutting against the end wall 47*a*; a plunger 49 slidably mounted to the body 48; a check valve 52 that is mounted between a high pressure chamber 50 and an oil chamber 51 and that is provided in one end of the plunger 49, the high pressure chamber 50 being formed between a closed end of the body 48 and one end of the plunger 49, the oil chamber 51 being formed in the plunger 49; and a return spring 53 provided between the body 48 and the plunger 49 so as to exert a spring force that urges the plunger 49 to a side where capacity of the high pressure chamber 50 is increased. One end of the rocker arm 22 is pivotably supported by a spherical head 49*a* formed in the other end of the plunger 49.

Figure 1:
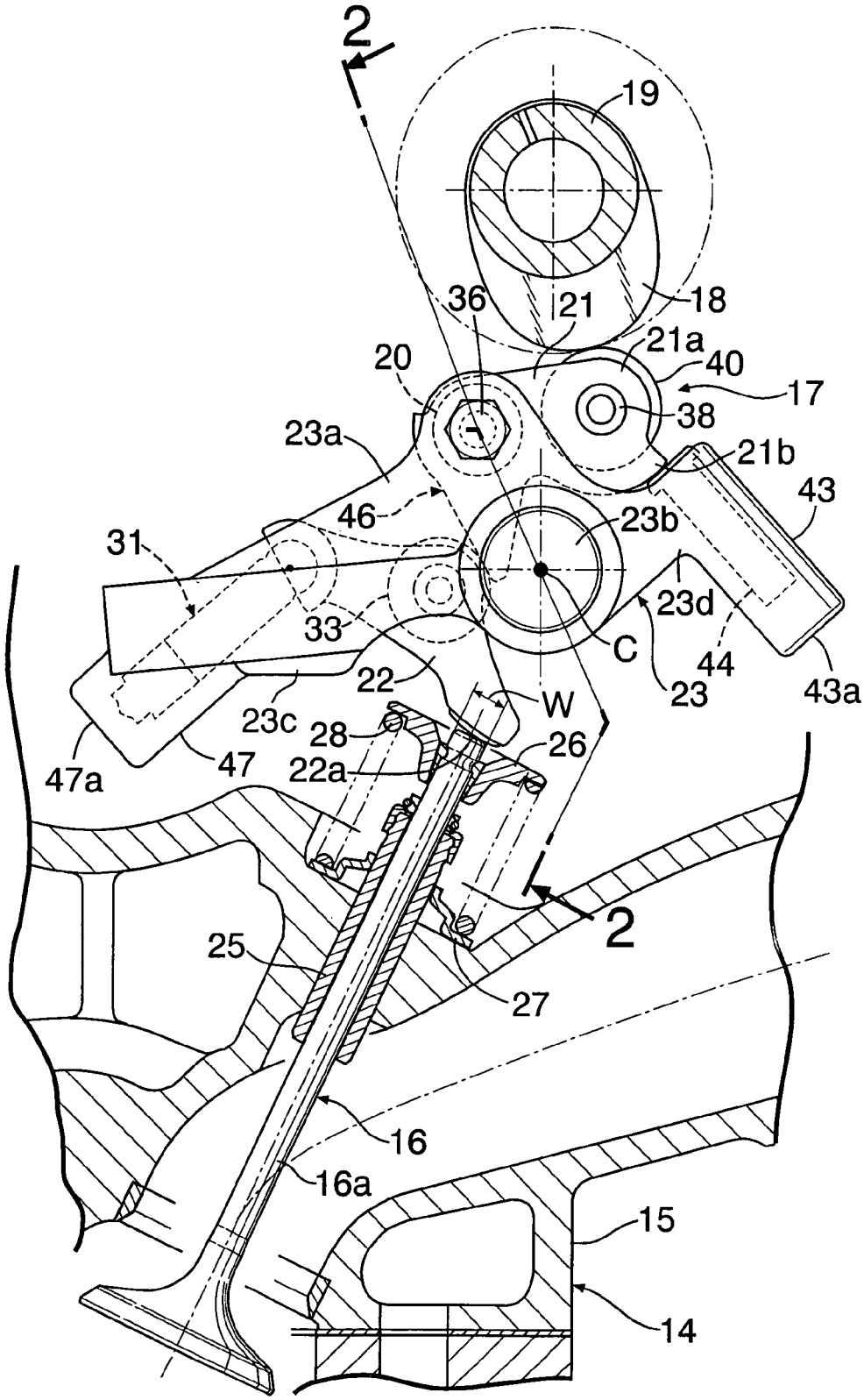
Figure 2:
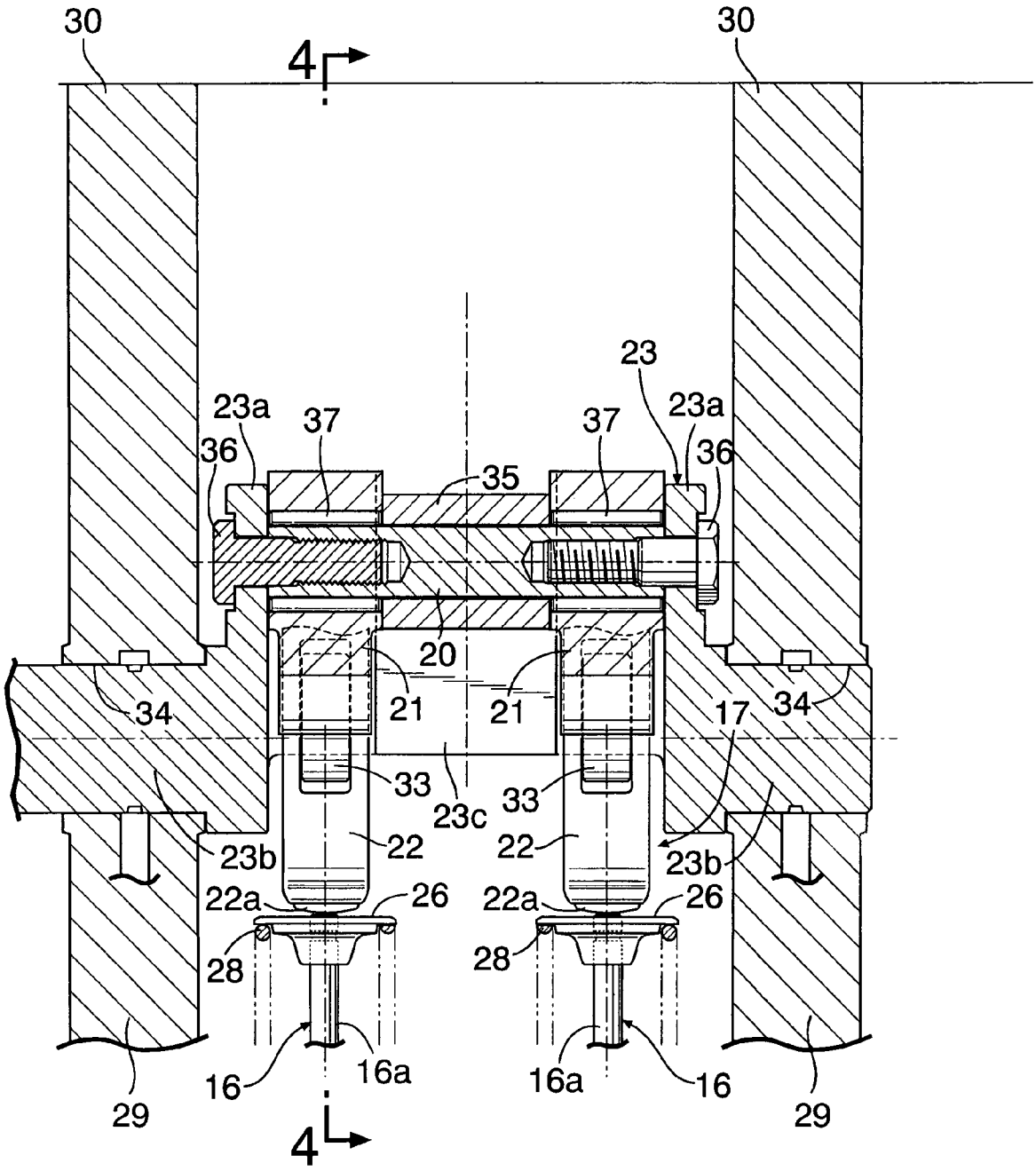
Figure 3:
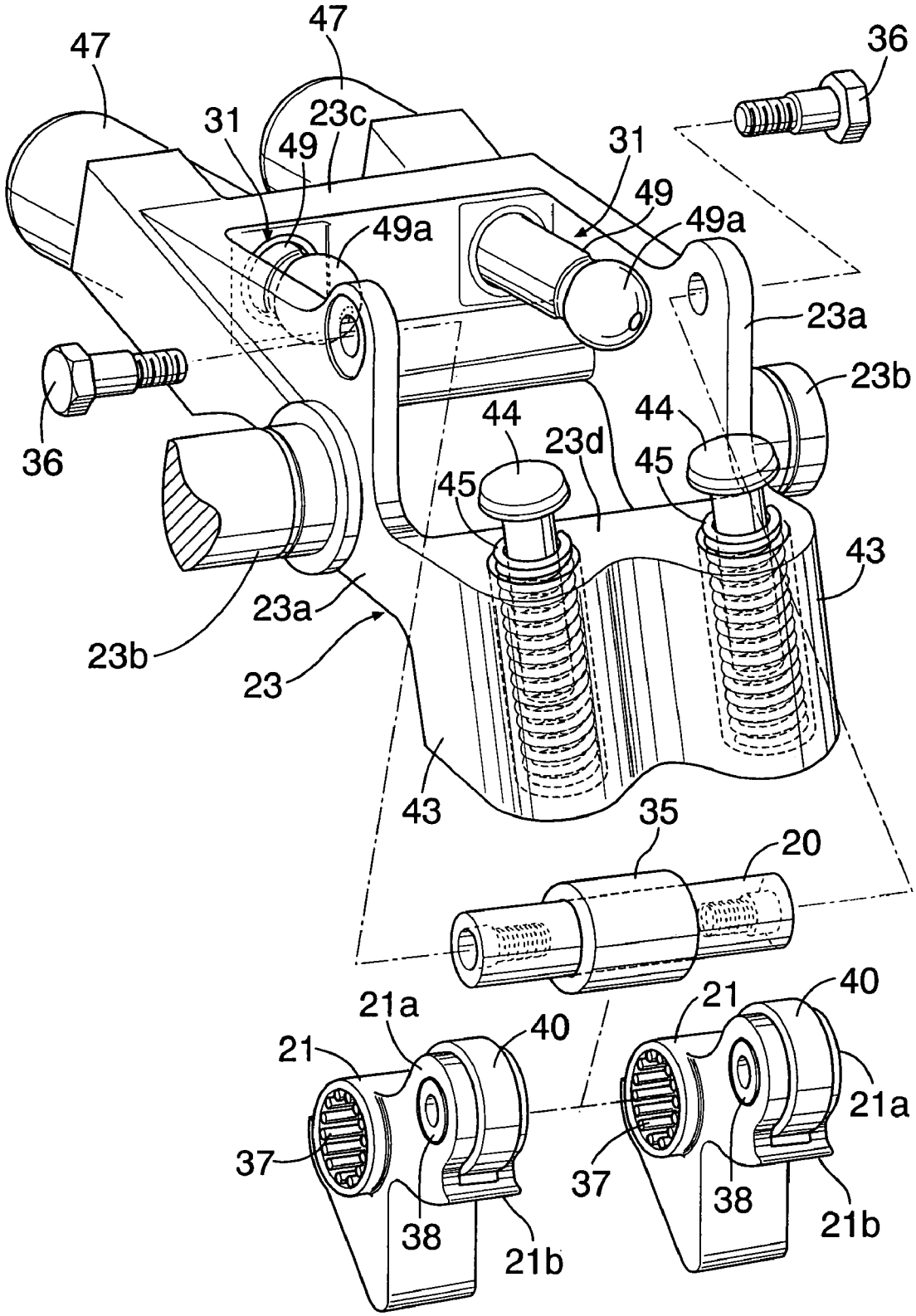
Figure 4:
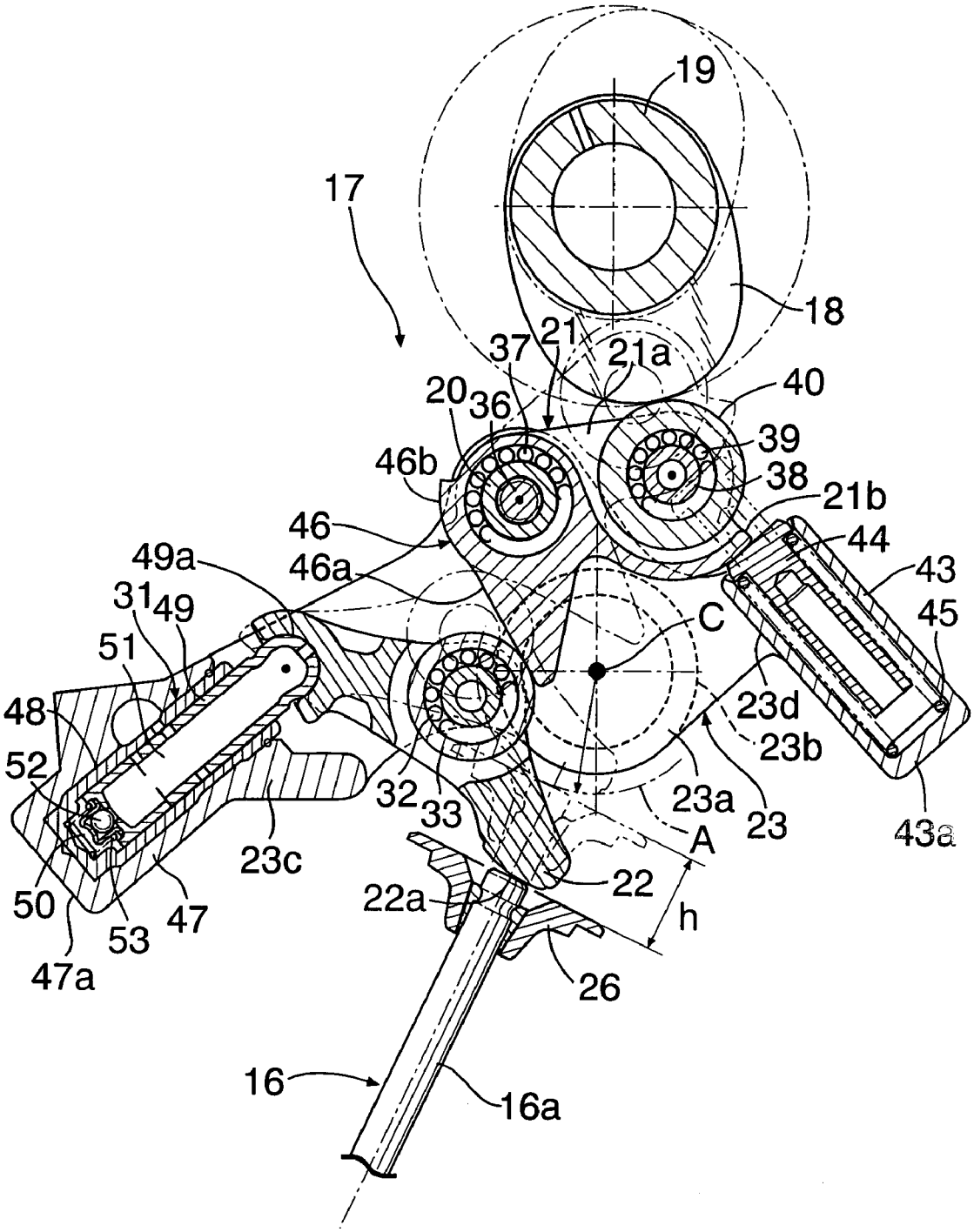
Figure 5:
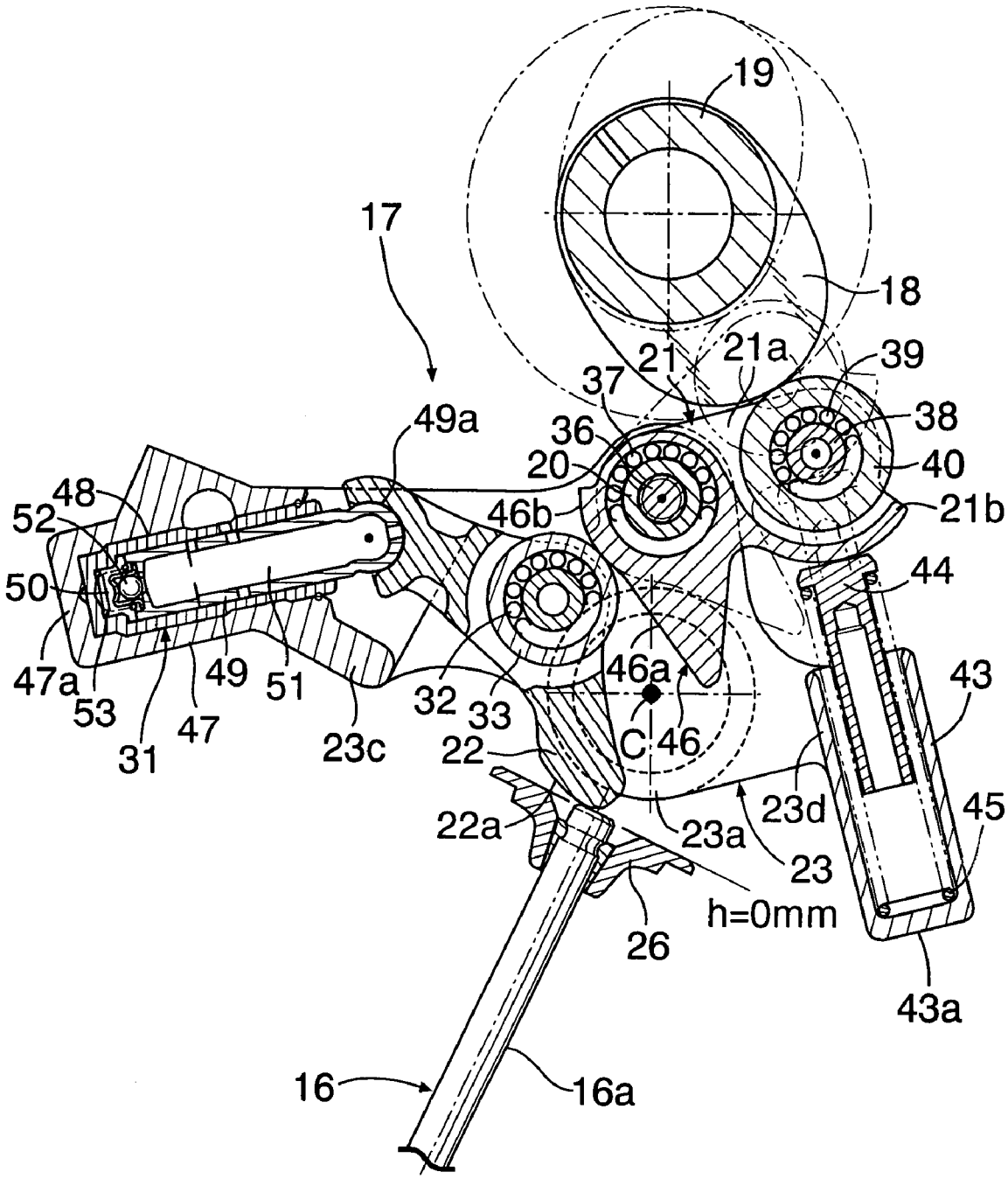

With the above described configuration, when the control arm 23 is placed in a position in FIG. 4 by the actuator 24, upper ends of the stems 16*a* and 16*a* of the intake valves 16 and 16 are driven in a valve opening direction at ends opposite from the base circular portions 46*b* and 46*b* of the lift portions 46*a* and 46*a* of the abutment surfaces 46 and 46 of the sub cams 21 and 21 rotated around the axis of the movable support shaft 20, and in this state, the lift amount h of the intake valves 16 and 16 becomes maximum. When the control arm 23 is rotated upward by the actuator 24 as shown in FIG. 5, for example, the upper ends of the stems 16*a* and 16*a* of the intake valves 16 and 16 abut against the base circular portions 46*b* and 46*b* of the abutment surfaces 46 and 46 of the subs cams 21 and 21, and in this state, the lift amount h of the intake valves 16 and 16 becomes minimum (=0).

Specifically, the control arm 23 is rotatably driven by the actuator 24 to vary the lift amount of the intake valves 16 and 16, and rotatably driving the control arm 23 also causes a change in timing at which the lift valve cams 18 and 18 are brought into contact with the second rollers 40 and 40, and thus causes a change in opening and closing timing of the intake valves 16 and 16.

Next, a structure of the actuator 24 that actuates the variable lift valve operating mechanism 17, and a structure of the default mechanism 60 for ensuring valve lift of the intake valves 16 and 16 in the event of failure of the actuator 24 will be described with reference to FIGS. 6 to 11.

The actuator 24 includes an electric motor 62 secured to a side wall of an actuator support portion 61 protruding from one end of the cylinder head 15 in a cylinder arranging direction. A drive shaft 64 connected to an output shaft 62*a* of the electric motor 62 via a joint 63 is supported rotatably by a needle bearing 67 and a ball bearing 68 in a housing 66 secured to a bottom of the actuator support portion 61 by bolts 65. The drive shaft 64 is placed in a twisted position perpendicularly to a cylinder arranging line, that is, perpendicularly to a control shaft 69 of the variable lift valve operating mechanism 17 placed in parallel with the cylinder arranging line on plan view. The control shaft 69 is connected coaxially with one shaft portion 23*b* of the control arm 23, and rotation of the control shaft 69 causes rotation of the control arm 23 integral therewith. A worm wheel 70 comprising a sector gear is secured to the control shaft 69. A worm 71 with which the worm wheel 70 meshes is provided on the drive shaft 64.

Thus, rotatably driving the electric motor 62 causes the control shaft 69 to pivot through an angle of 94° via the output shaft 62*a*, the drive shaft 64, the worm 71, and the worm wheel 70. The intake valves 18 and 18 are in a maximum lift state (see FIG. 4) at one pivot end (a pivot angle of 94°) of the control shaft 69, and a minimum lift state (see FIG. 5) at the other pivot end (a pivot angle of 0°) of the control shaft 69.

A first lever 73 and a second lever 74 are pivotably secured to opposite ends of a support shaft 72 horizontally passing through the housing 66. In the first lever 73 having a base 73*a* at a lower end pivotably supported by the support shaft 72, one end extending upward from the support shaft 72 and horizontally bent is a pressed portion 73*b* urged downward by a first coil spring 75, and the other end extending upward from the support shaft 72 is a cam portion 73*c*.

A first spring guide 76 comprising a bolt is vertically screwed in an upper surface of the housing 66. The first coil spring 75 is provided under compression between a retainer 77 that is fitted on an upper end of the first spring guide 76 and locked by a head 76*a* of the first spring guide 76, and a first slider 78 slidably fitted to a lower portion thereof. A tip end of the pressed portion 73*b* of the first lever 73 is branched into two, and the branched portions are slidably fitted to an outer periphery of the rod-shaped first spring guide 76 and guided.

Structures of the second lever 74, a second coil spring 79, a spring guide 80, a retainer 81, and a second slider 82 which are placed on the side opposite from the first lever 73 and the first coil spring 75 with the housing 66 therebetween, are substantially the same as the structures of the first lever 73, the first coil spring 75, the first spring guide 76, the retainer 77, and the first slider 78. The second lever 74 includes a base 74*a* and a pressed portion 74*b* only, and includes no component corresponding to the cam portion 73*c* of the first lever 73, which is different from the first lever 73.

The first lever 73 pressed downward at the pressed portion 73*b* by an arcuate pressing portion 78*a* at a lower end of the first slider 78 is stopped in a position where a lower surface of the pressed portion 73*b* abuts against a stopper 83. Similarly, the second lever 74 pressed downward at the pressed portion 74*b* by an arcuate pressing portion 82*a* at a lower end of the second slider 82 is stopped in a position where a lower surface of the pressed portion 74*b* abuts against a stopper 84. A roller 86 that can abut against the cam portion 73*c* of the first lever 73 is supported by a tip end of an arm 85 provided on the end of the control shaft 69.

The actuator 24 (except the electric motor 62) and the default mechanism 60 including the above described configurations are housed in a space between the actuator support portion 61 and a head cover 87 at the end of the cylinder head 15.

Next, an operation of the default mechanism 60 having the above described configuration will be described with reference to FIGS. 12A to 12C.

Figure 12A:
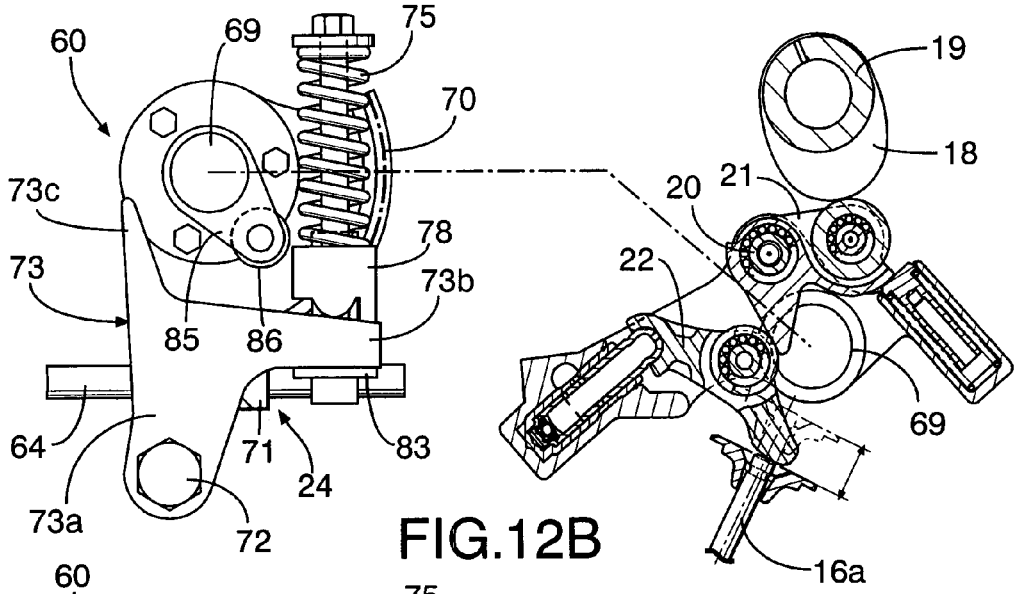

As shown in FIG. 12A, when the variable lift valve operating mechanism 17 is in a high lift state, the control shaft 69 connected to the control arm 23 is stopped in a counterclockwise rotation limit position (the rotation angle of 94°). At this time, the pressed portions 73*b* and 74*b* of the first and second levers 73 and 74 abut against and are stopped by the stoppers 83 and 84, respectively, with resilient forces of the first and second coil springs 75 and 79. The cam portion 73*c* of the first lever 73 is spaced apart from a roller 86 on the tip end of the arm 85 of the control shaft 69.

Figure 12B:
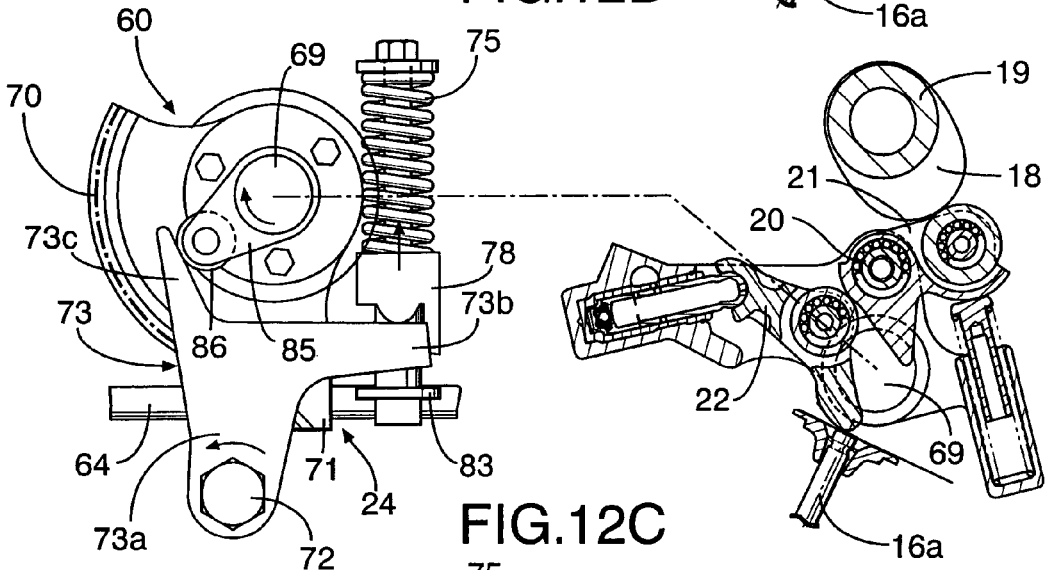
Figure 12C:
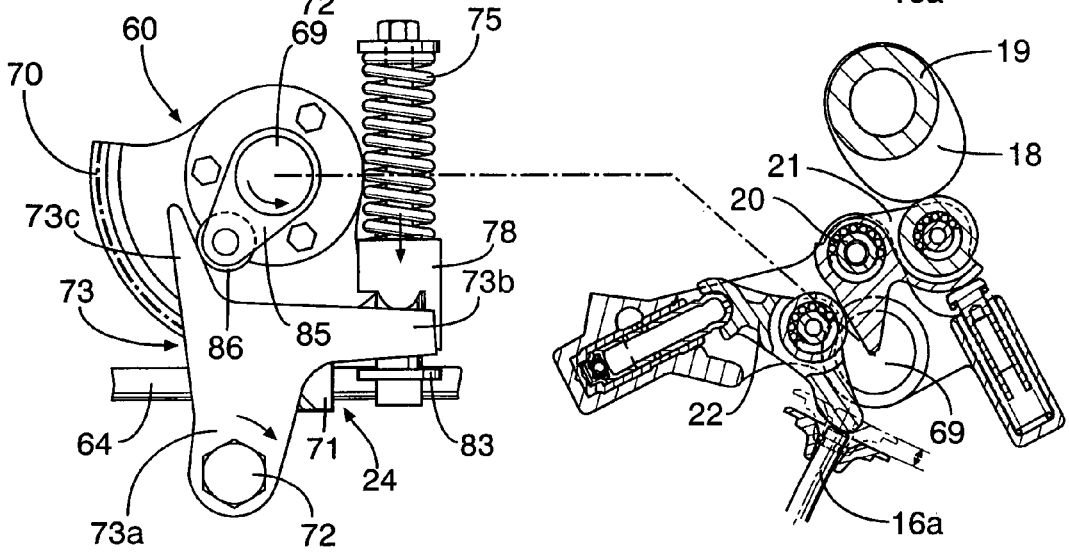

As shown in FIG. 12B, if the control shaft 69 connected to the control arm 23 is rotated to a clockwise rotation limit position (the rotation angle of 0°) to vary the variable lift valve operating mechanism 17 from the high lift state to a low lift state, the roller 86 on the tip end of the arm 85 of the control shaft 69 rotated clockwise presses the cam portion 73*c* of the first lever 73. Thus, the first and second levers 73 and 74 are pivotably supported on the support shaft 72, and the pressed portions 73*b* and 74*b* push up the first and second sliders 78 and 82 to compress the first and second coil springs 75 and 79.

In this state, if the actuator 24 fails and the control shaft 69 is stopped in the position in FIG. 12B, the intake valves 16 and 16 are fixed in the low lift state (the lift amount of zero), which prevents the internal combustion engine from being started or operated. According to the embodiment, however, as shown in FIG. 12C, even if the actuator 24 fails, the compressed first and second coil springs 75 and 79 press downward the pressed portions 73*b* and 74*b* of the first and second levers 73 and 74 via the first and second sliders 78 and 82 to rotate the first and second levers 73 and 74 clockwise through a predetermined angle. Thus, the arm 85 having the roller 86 pressed by the cam portion 73*c* of the first lever 73 rotates the control shaft 69 counterclockwise through a predetermined angle (36° in the embodiment), thereby securing the valve lift of the intake valves 16 and 16 in a required amount larger than zero (2 mm in the embodiment) to allow the internal combustion engine to be started or operated, and allowing a vehicle to drive to a service garage.

As described above, the support shaft 72 that pivotably supports the first lever 73 of the default mechanism 60 is offset from the rotation axis C of the control shaft 69. Thus, as compared with the case where the support shaft 72 is placed coaxially with the control shaft 69, a large torque is input from the first lever 73 to the control shaft 69 to reliably prevent the valve lift from being a predetermined value or lower in the event of failure of the actuator 24.

The intermediate portion of the first lever 73 that urges the control shaft 69 in one direction is pivotably supported by the support shaft 72, and one end of the first lever 73 is urged by the first coil spring 75 and the other end thereof abuts the arm 85 of the control shaft 69, thereby allowing the first lever 73 to be made compact, and also allowing the first coil spring 75 to be made compact by increasing a lever ratio of the first lever 73.

Further, the support shaft 72 of the first and second levers 73 and 74 is placed below the meshing portion between the worm wheel 70 and the worm 71 of the actuator 24 in the cylinder axial direction, thereby allowing the first and second levers 73 and 74 to be placed in a compact manner using the space below the worm 71 without interference with the worm wheel 70 and the worm 71. The distance from the support shaft 72 to the ends of the first and second levers 73 and 74 can be increased, thereby allowing the first and second coil springs 75 and 79 to be made compact by increasing a lever ratio.

The pressed portions 73*b* and 74*b* of the first and second levers 73 and 74 are each branched into two and slidably engage the first and second spring guides 76 and 80, thereby preventing the first and second levers 73 and 74 from falling, and allowing smooth driving of the arm 85. Further, the first lever 73 urged by the first coil spring 75 and the second lever 74 urged by the second coil spring 79 are placed in parallel with each other with the worm wheel 70 therebetween, thereby allowing a sufficient urging force to be applied to the first lever 73 by the resilient forces of the first and second coil springs 75 and 79 while making the entire default mechanism 60 compact, or allowing setting flexibility of the urging force to be increased.

Further, the pair of spring guides 76 and 76 are provided on the opposite sides of the drive shaft 64 that drives the control shaft 69, thereby avoiding the interference between the spring guides 76 and the drive shaft 64.

Furthermore, at least part of the driven gear 70 overlaps the pair of spring guides 76 in the axial direction of the control shaft 69, and is placed between the pair of rod-shaped spring guides 76, thereby arranging the driven gear 70 and the spring guides 76 in a compact manner.

The embodiments of the present invention have been described above, but various changes in design may be made without departing from the subject matter of the present invention.

For example, in the embodiment, the intake valves 16 and 16 are illustrated as the engine valve, but the engine valve of the present invention may be an exhaust valve.

In the embodiment, the driving force of the electric motor 62 is transmitted to the control shaft 69 via the worm 71 and the worm wheel 70, but any types of gears may be used other than the worm 71 and the worm wheel 70.

In the embodiment, the first lever 73 is illustrated as the urging member, but the urging member of the present invention may be any member such as a cam or a linkage.

Figure 13:
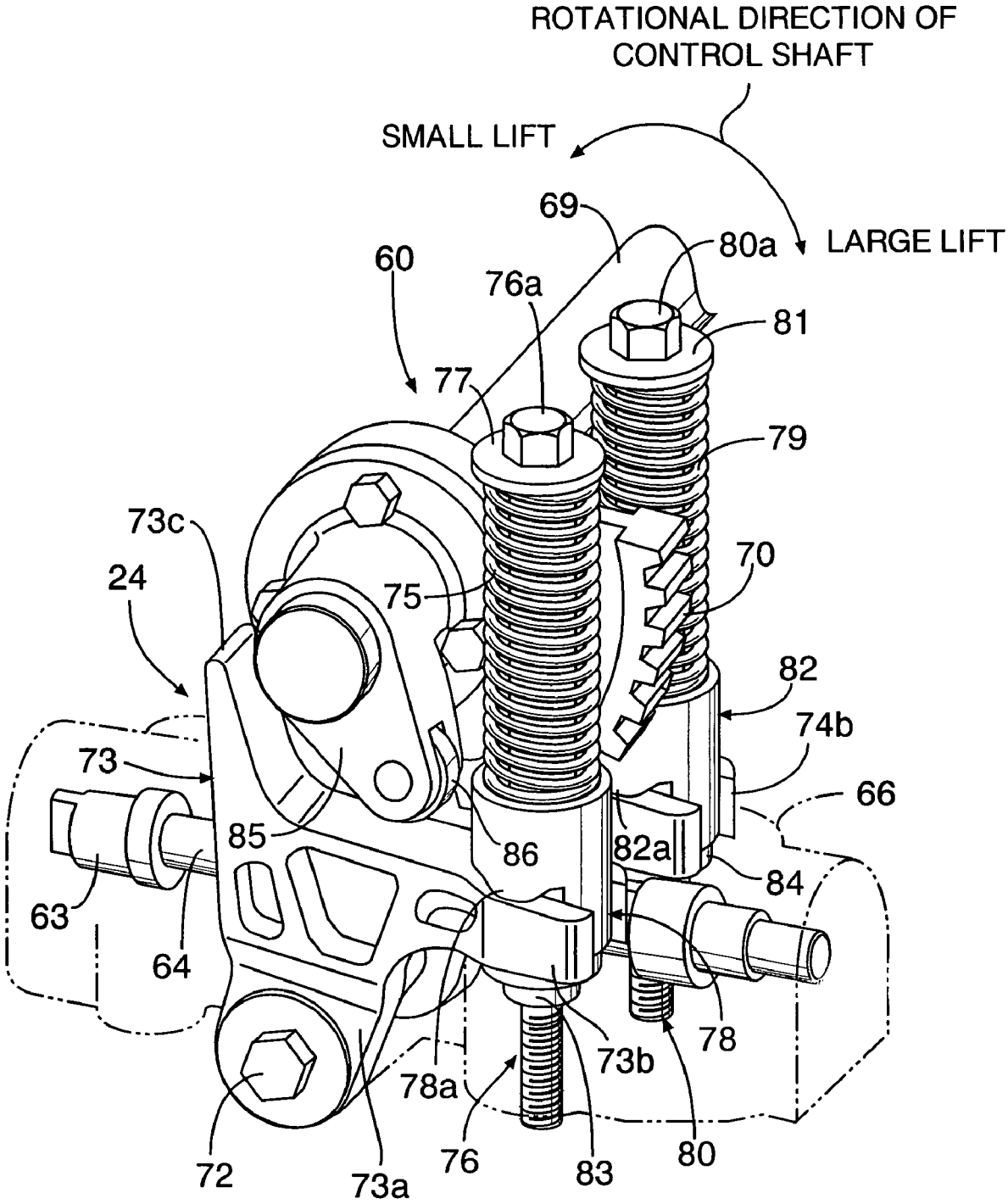
FIG. 13 is a view of another embodiment of the present invention, corresponding to FIG. 6.

In the embodiment, the default mechanism 60 prevents the valve lift from being the predetermined value or lower. As shown in FIG. 13, however, if the relationship between the rotational direction of the control shaft 69 and the increase/decreasing direction of the valve lift is set inversely to those in the embodiment in FIG. 6, the default mechanism 60 can prevent the valve lift from being the predetermined value or higher.

Figure 14:
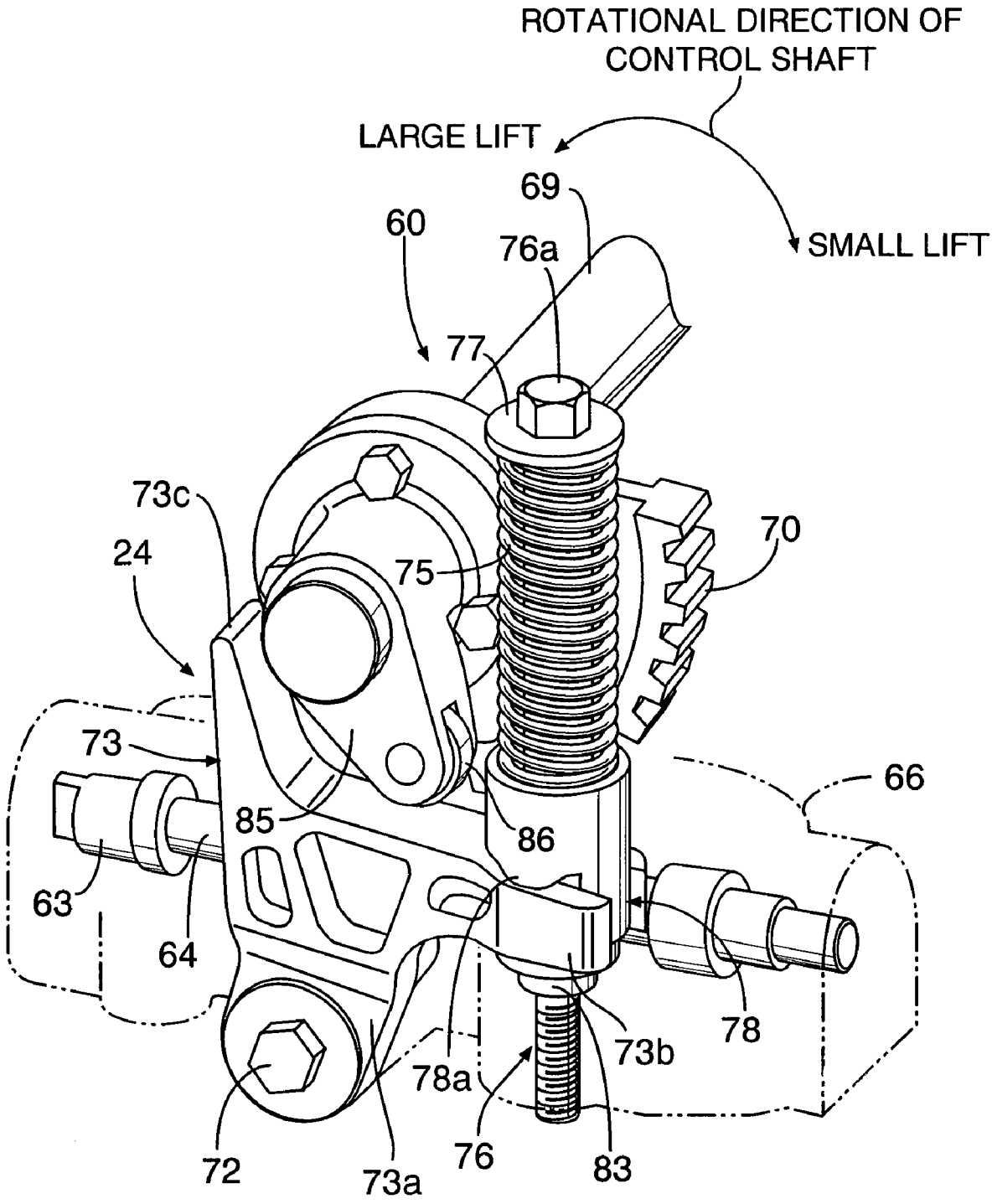
FIG. 14 is a view of still another embodiment of the present invention, corresponding to FIG. 6.

Further, as shown in FIG. 14, among the first lever 73, the first coil spring 75 and the first spring guide 76 on one side of the housing 66 and the second lever 74, the second coil spring 79 and the second spring guide 80 on the other side of the housing 66, members on either side, for example, the second lever 74, the second coil spring 79 and the second spring guide 80 may be omitted.

What is claimed is:

1. A default device of an actuator for a variable lift valve operating mechanism in which in the event of failure of an actuator that rotatably drives a control shaft of a variable lift valve operating mechanism capable of varying valve lift of an engine valve of an internal combustion engine, the control shaft is urged in one direction by an urging member of a default mechanism to prevent the valve lift from being a predetermined value or lower or higher, wherein a support shaft that pivotably supports the urging member is offset from a rotation axis of the control shaft, and wherein the urging member is a lever pivotably supported at an intermediate portion thereof by the support shaft, and one end of the lever is urged by a spring and the other end thereof abuts a driven portion of the control shaft.

2. The default device of an actuator for a variable lift valve operating mechanism according to claim 1, wherein the actuator comprises a driven gear provided on the control shaft, and a drive gear that meshes with a lower portion of the driven gear, and the support shaft of the lever is placed below the drive gear in a cylinder axial direction.

3. The default device of an actuator for a variable lift valve operating mechanism according to claim 1, wherein one end of the lever slidably engages a rod-shaped spring guide that guides expansion and contraction of the spring.

4. The default device of an actuator for a variable lift valve operating mechanism according to claim 2, wherein one end of the lever slidably engages a rod-shaped spring guide that guides expansion and contraction of the spring.

5. The default device of an actuator for a variable lift valve operating mechanism according to claim 4, wherein the rod-shaped spring guide is provided on at least one side of a drive shaft that drives the control shaft.

6. The default device of an actuator for a variable lift valve operating mechanism according to claim 4, wherein a pair of the rod-shaped spring guides are provided on opposite sides of a drive shaft that drives the control shaft.

7. The default device of an actuator for a variable lift valve operating mechanism according to claim 4, wherein at least part of the driven gear overlaps the rod-shaped spring guide in an axial direction of the control shaft.

8. The default device of an actuator for a variable lift valve operating mechanism according to claim 3, wherein the rod-shaped spring guide is provided on at least one side of a drive shaft that drives the control shaft.

9. The default device of an actuator for a variable lift valve operating mechanism according to claim 3, wherein a pair of the rod-shaped spring guides are provided on opposite sides of a drive shaft that drives the control shaft.

10. The default device of an actuator for a variable lift valve operating mechanism according to claim 3, wherein at least part of the driven gear overlaps the rod-shaped spring guide in an axial direction of the control shaft.

11. The default device of an actuator for a variable lift valve operating mechanism according to claim 8, wherein at least part of the driven gear overlaps a pair of the rod-shaped spring guides in an axial direction of the control shaft, and is placed between the pair of rod-shaped spring guides.

12. The default device of an actuator for a variable lift valve operating mechanism according to claim 9, wherein at least part of the driven gear overlaps a pair of the rod-shaped spring guides in an axial direction of the control shaft, and is placed between the pair of rod-shaped spring guides.

13. A default device of an actuator for a variable lift valve operating mechanism in which in the event of failure of an actuator that rotatably drives a control shaft of the variable lift valve operating mechanism capable of varying valve lift of an engine valve of an internal combustion engine, the control shaft is urged in one direction by an urging member of a default mechanism to prevent the valve lift from being a predetermined value or lower or higher, wherein a support shaft that pivotably supports the urging member is offset from a rotational axis of the control shaft, and wherein the actuator comprises a driven gear provided on the control shaft, and a drive gear that meshes with a lower portion of the driven gear, and the support shaft of the lever is placed below the drive gear in a cylinder axial direction.

14. The default device of an actuator for a variable lift valve operating mechanism according to claim 13, wherein one end of the lever slidably engages a rod-shaped spring guide that guides expansion and contraction of the spring.

15. The default device of an actuator for a variable lift valve operating mechanism according to claim 14, wherein the rod-shaped spring guide is provided on at least one side of a drive shaft that drives the control shaft.

16. The default device of an actuator for a variable lift valve operating mechanism according to claim 15, wherein at least part of the driven gear overlaps a pair of the rod-shaped spring guides in an axial direction of the control shaft, and is placed between the pair of rod-shaped spring guides.

17. The default device of an actuator for a variable lift valve operating mechanism according to claim 14, wherein a pair of the rod-shaped spring guides are provided on opposite sides of a drive shaft that drives the control shaft.

18. The default device of an actuator for a variable lift valve operating mechanism according to claim 17, wherein at least part of the driven gear overlaps a pair of the rod-shaped spring guides in an axial direction of the control shaft, and is placed between the pair of rod-shaped spring guides.

19. The default device of an actuator for a variable lift valve operating mechanism according to claim 14, wherein at least part of the driven gear overlaps the rod-shaped spring guide in an axial direction of the control shaft.

* * * * *